US008752561B1

(12) United States Patent
Wendschuh

(10) Patent No.: US 8,752,561 B1
(45) Date of Patent: Jun. 17, 2014

(54) APPARATUS FOR ADORNING PONYTAIL AND ASSOCIATED METHODS

(71) Applicant: Susan B. Wendschuh, Avon, OH (US)

(72) Inventor: Susan B. Wendschuh, Avon, OH (US)

( * ) Notice: Subject to any disclaimer, the term of this patent is extended or adjusted under 35 U.S.C. 154(b) by 0 days.

(21) Appl. No.: 13/741,748

(22) Filed: Jan. 15, 2013

(51) Int. Cl.

| | |
|---|---|
| ***A45D 7/00*** | (2006.01) |
| ***A45D 8/12*** | (2006.01) |
| ***A45D 8/00*** | (2006.01) |
| ***A45D 2/20*** | (2006.01) |
| ***A45D 8/34*** | (2006.01) |
| ***A45D 8/36*** | (2006.01) |

(52) U.S. Cl.
CPC .. *A45D 8/34* (2013.01); *A45D 8/36* (2013.01); *A45D 8/00* (2013.01)
USPC ..... 132/200; 132/275; 132/273; 132/247

(58) Field of Classification Search
CPC ..... A45D 8/00; A45D 8/14; A45D 8/16; A45D 8/34; A45D 8/36; A45D 2008/002; A45D 2008/004
USPC ..... 132/275, 200, 212, 132, 133, 222, 236, 132/240, 241, 243, 245, 246, 247, 250, 252, 132/273, 276, 278, 319, 333, 54, 55; 206/581; 2/171.5, 171.8, 207, 918, 2/DIG. 11; D28/10, 39, 41, 99; 24/17 A, 24/306, 442; 119/600, 850, 857, 858
See application file for complete search history.

(56) References Cited

U.S. PATENT DOCUMENTS

| | | | | | |
|---|---|---|---|---|---|
| 2,864,383 | A | | 12/1958 | Jacks et al. | |
| 2,945,500 | A | | 7/1960 | Bolinger | |
| 3,000,384 | A | * | 9/1961 | Piers, Jr. | 132/273 |
| 3,211,160 | A | * | 10/1965 | Miller | 132/275 |
| 3,542,041 | A | * | 11/1970 | Mercorella | 132/275 |
| 4,785,834 | A | * | 11/1988 | Gonzalez | 132/275 |
| 5,044,385 | A | | 9/1991 | Rhodes | |
| 5,086,543 | A | * | 2/1992 | Mitchell | 24/16 PB |
| 5,293,884 | A | * | 3/1994 | Chapman et al. | 132/200 |
| 5,379,782 | A | | 1/1995 | Tabb | |
| 5,465,741 | A | * | 11/1995 | Dvorak | 132/275 |
| 5,472,003 | A | * | 12/1995 | Frame et al. | 132/275 |
| D370,086 | S | | 5/1996 | Yeh | |
| 5,622,194 | A | | 4/1997 | Ledda-Vengerder | |
| 5,626,503 | A | * | 5/1997 | Heftel et al. | 446/73 |
| D385,061 | S | | 10/1997 | Malik | |
| 5,706,836 | A | * | 1/1998 | McKeown | 132/144 |
| D391,674 | S | | 3/1998 | Meehan | |
| 5,727,575 | A | * | 3/1998 | Rontal | 132/200 |
| 5,730,161 | A | * | 3/1998 | Kohanek | 132/273 |
| 5,799,672 | A | * | 9/1998 | Hansbury | 132/273 |

(Continued)

*Primary Examiner* — Vanitha Elgart
(74) *Attorney, Agent, or Firm* — Fay Sharpe LLP

(57) ABSTRACT

A ponytail holder includes an outer covering with a front surface and a hook fabric with a hook surface. The ponytail holder may include a tube with inner and outer surfaces and a longitudinal slit forming opposing longitudinal edges. The ponytail holder may also include end caps. A storage device for storage a plurality of the ponytail holders is described along with a kit for making the ponytail holder and a method of manufacturing the ponytail holder. Various embodiments of the ponytail holder, storage device, kit, and method of manufacturing the ponytail holder are described. The ponytail holder is configured for placement around a constricted area of a bundle of hair and over an existing elastic band that surrounds the bundle and forms the constricted area. The hook fabric is configured to mate with the existing elastic band such that the outer covering adorns the bundle of hair.

23 Claims, 11 Drawing Sheets

(56) References Cited

U.S. PATENT DOCUMENTS

| | | | | |
|---|---|---|---|---|
| 6,024,103 | A * | 2/2000 | Hansbury | 132/275 |
| 6,062,232 | A * | 5/2000 | Johnson | 132/273 |
| 6,260,555 | B1 | 7/2001 | Natvig | |
| 6,263,885 | B1 | 7/2001 | Levy | |
| D447,281 | S | 8/2001 | Maturaporn | |
| 6,276,369 | B1 * | 8/2001 | Rogers | 132/273 |
| D449,134 | S | 10/2001 | Maturaporn | |
| D450,885 | S | 11/2001 | Neary et al. | |
| D453,239 | S | 1/2002 | Minelli | |
| 6,397,854 | B1 | 6/2002 | Bailey | |
| 6,425,405 | B1 | 7/2002 | McRoberts | |
| D475,804 | S | 6/2003 | Stachowski | |
| 6,638,133 | B1 * | 10/2003 | Brancolino et al. | 446/73 |
| 6,688,316 | B1 * | 2/2004 | Klug | 132/286 |
| 6,799,581 | B2 | 10/2004 | Cave | |
| 6,981,507 | B2 * | 1/2006 | Gabriele-Baumann | 132/275 |
| D535,055 | S | 1/2007 | Been et al. | |
| D542,971 | S | 5/2007 | Shidler et al. | |
| D554,800 | S | 11/2007 | Moudgill | |
| D594,598 | S | 6/2009 | Pena | |
| 7,581,548 | B2 | 9/2009 | Henricksen et al. | |
| 8,061,366 | B2 * | 11/2011 | Britton et al. | 132/200 |
| 8,136,534 | B2 * | 3/2012 | D'Assis et al. | 132/56 |
| 2002/0056467 | A1 | 5/2002 | Srivastava | |
| 2006/0260634 | A1 | 11/2006 | Henricksen et al. | |
| 2008/0156340 | A1 * | 7/2008 | Hopper et al. | 132/275 |
| 2010/0269765 | A1 * | 10/2010 | Barghahn | 119/850 |
| 2010/0275947 | A1 | 11/2010 | Keesy | |
| 2010/0277944 | A1 * | 11/2010 | Hurwitz | 362/570 |
| 2010/0319167 | A1 * | 12/2010 | Nirmel | 24/306 |

* cited by examiner

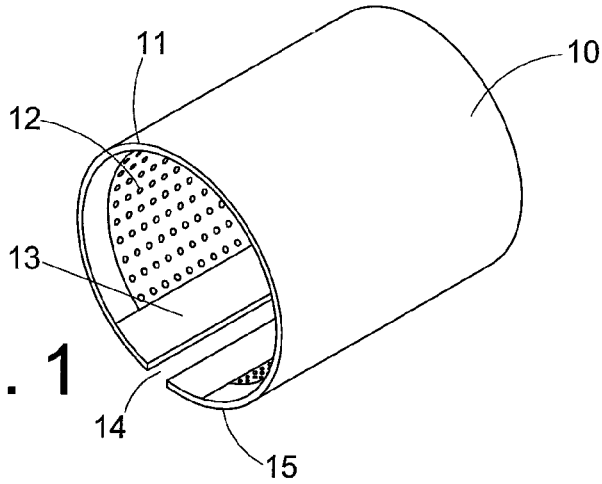
FIG. 1
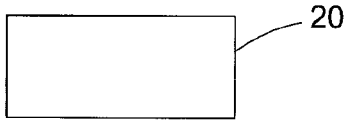
FIG. 2A
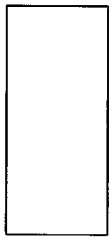
FIG. 2C
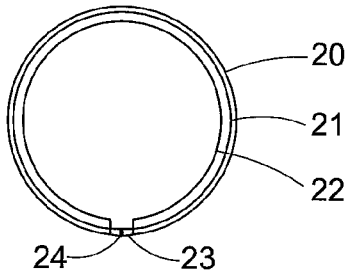
FIG. 2B
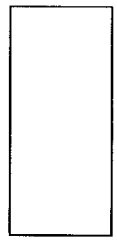
FIG. 2D
FIG. 2E
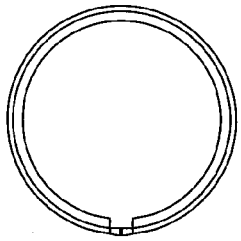
FIG. 2F
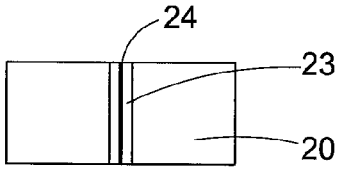

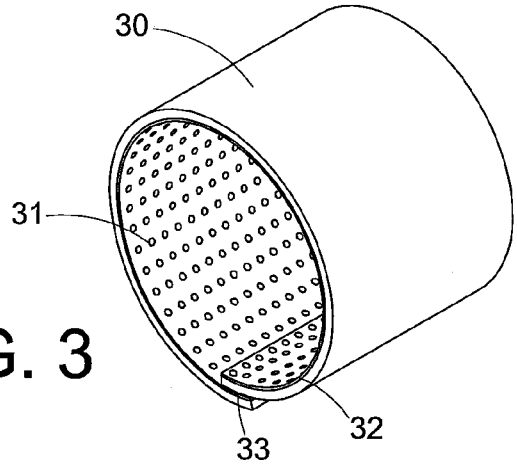
FIG. 3
FIG. 4A
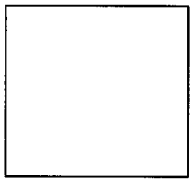
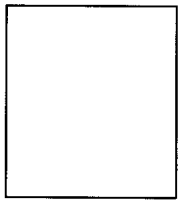
FIG. 4C
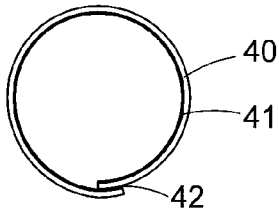
FIG. 4B
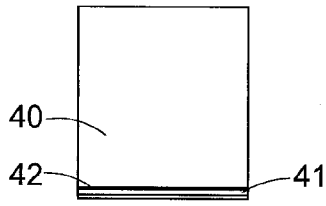
FIG. 4D
FIG. 4E
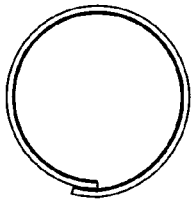
FIG. 4F
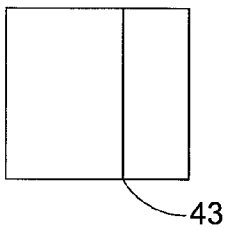

APPARATUS FOR ADORNING PONYTAIL AND ASSOCIATED METHODS

BACKGROUND

This disclosure relates to a ponytail holder for adorning a ponytail, a kit for making the ponytail holder, a method for manufacturing the ponytail holder, and a storage device for storing such ponytail holders. While various embodiments of the ponytail holder, kit, method, and storage device are described in relation to adorning a ponytail, it is understood that the item referred to as the ponytail holder can also be used to adorn other objects, such as drapes, napkins, or pillows. The ponytail holder may also be used as a bracelet, belt, pet collar, or as a pet tail adornment.

Existing ponytail holders or adornments have several disadvantages. For example, existing ponytail holders or adornments may have the following characteristics: i) too juvenile, too feminine, or too "fussy;" ii) difficult to insert or put in place; iii) problems staying in place, particularly during active situations; iv) difficult to store or transport without becoming wrinkled or damaged; v) too heavy; and vi) visible hinges, parts, or hardware.

Many ponytail holders or adornments, when inserted into the hair, form the appearance of ruffles, bows, or layers of gathered fabric. This appearance, for many, is too juvenile, overly feminine looking, or "fussy". Many ponytail holders or adornments are difficult to insert. For example, sometimes two or more mirrors may be required, much adjustment, and the help of another person may be required. This may be why many women that have their hair in a ponytail use the bare, unattractive, elastic band without any adornment. For example, such elastic bands are distributed Conair Corporation of East Windsor, N.J. under the "Scünci" brand name. Model numbers 17278 and 22853 are examples of "Scünci" brand hair ties.

Many existing ponytail holders do not provide sufficient means to stay accurately placed, particularly when the wearer is moving actively. Many types of ponytail holders are difficult to store or transport. Ponytail holders may become wrinkled or disheveled from storage or during transport. This makes the ponytail holder less attractive for subsequent use. For example, ponytail holders that include bows, layers, or folds of fabric may require much extra care, such as steaming to remove wrinkles or the need to store them in space-consuming boxes. This is a disadvantage, especially for travelers.

Many existing hair adornments are too heavy and cause the person wearing the adornment to feel as if an uncomfortable weight was added to the back of the head by the adornment. Many of the opening and closing adornments for the hair are operated with clips or hinges. This type of hardware on an adornment is usually visible during normal wear. The operating mechanisms of these devices detract from the beauty of the adornment.

For these and other reasons, there is a need for an improved ponytail holder that is i) simple and professional-looking; ii) easy to put in place and reliably stays in place, even when the wearer is very active; iii) easy to store and transport; iv) lightweight; and v) avoids revealing unattractive components.

SUMMARY

In one aspect, an apparatus for adorning a ponytail is provided. In one embodiment, the apparatus includes: an outer covering including a front surface, the outer covering having a select width and a select length and configured to adorn at least a constricted area of a bundle of hair; and a hook fabric including a hook surface, the hook fabric having width and length dimensions that do not exceed the select width and select length of the outer covering, wherein the hook fabric is assembled with the outer covering such that the hook surface of the hook fabric faces away from the outer covering and the front surface of the outer covering faces away from the hook fabric. The assembled apparatus is configured for placement around the bundle and over an existing elastic band that surrounds the bundle and forms the constricted area. The hook fabric is configured to mate with the existing elastic band in conjunction with placement of the assembled apparatus around the bundle such that the outer covering adorns the bundle of hair and the existing elastic band is obscured from view.

In a further embodiment of the apparatus, the hook surface of the hook fabric is configured to mate with an exterior surface of the existing elastic band in a hook-and-loop fastening manner in conjunction with placement of the assembled apparatus around the bundle.

In another further embodiment, the apparatus also includes: a tube including inner and outer surfaces and a longitudinal slit forming opposing longitudinal edges, the tube sized in relation to the outer covering and the constricted area of the bundle of hair to be adorned. The hook fabric is secured to the inner surface of the tube such that the hook surface of the hook fabric faces away from the tube. The tube is configured to receive the constricted area of the bundle of hair through the longitudinal slit in conjunction with placement of the assembled apparatus around the bundle.

In yet another further embodiment of the apparatus, a back surface of the outer covering is secured to the hook fabric to form a ribbon-like strip with opposing ends. In this embodiment, the apparatus also includes: a fastening mechanism with mating fastener components secured to the opposing ends of the ribbon-like strip.

In still another further of the apparatus, the outer covering includes front and back portions forming a sleeve with opposing open ends. In this embodiment, the apparatus also includes; a tube including inner and outer surfaces and a longitudinal slit forming opposing longitudinal edges, the tube sized in relation to the outer covering and the constricted area of the bundle of hair to be adorned. The hook fabric is secured to the back portion of the outer covering such that the hook surface of the hook fabric faces away from the outer covering. The combined outer covering and hook fabric is configured to slide over the tube by feeding a first longitudinal edge through the sleeve from a first open end until both longitudinal edges are covered by the sleeve. The covered tube is configured to receive the constricted area of the bundle of hair through the longitudinal slit in conjunction with placement of the assembled apparatus around the bundle.

In another aspect, a kit for making a ponytail holder configured to adorn a ponytail is provided. In one embodiment, the kit includes: a template to produce an outer covering with a front surface, the template defining a select width and a select length for the outer covering, the outer covering configured to adorn at least a constricted area of a bundle of hair; a hook fabric including a hook surface, the hook fabric having width and length dimensions that do not exceed the select width and select length for the outer covering, wherein the hook fabric is configured to be assembled with the outer covering such that the hook surface of the hook fabric faces away from the outer covering and the front surface of the outer covering faces away from the hook fabric; a tube including inner and outer surfaces and a longitudinal slit forming opposing longitudinal edges, the tube sized in relation to the outer covering and the constricted area of the bundle of hair to be adorned; and end caps configured to be secured to at least one of the outer covering, hook fabric, and tube along each longitudinal edge of the tube. The assembled ponytail holder is configured for placement around the bundle and over an existing elastic band that surrounds the bundle and forms the constricted area. The hook fabric is configured to mate with the existing elastic band in conjunction with placement of the assembled apparatus around the bundle such that the outer covering adorns the bundle of hair and the existing elastic band is obscured from view.

In yet another aspect, a method of manufacturing an apparatus for adorning a ponytail is provided. In one embodiment, the method includes: obtaining an outer covering, a hook fabric, a tube, and two end caps, the outer covering including a front surface and having a select width and a select length, the hook fabric including a hook surface and having width and length dimensions that do not exceed the select width and select length of the outer covering, the tube including inner and outer surfaces and a longitudinal slit forming opposing longitudinal edges, the tube sized in relation to the outer covering; securing the hook fabric to the inner surface of the tube such that the hook surface of the hook fabric faces away from the tube; securing the outer covering to the outer surface of the tube such that the front surface of the outer covering faces away from the tube; and securing the end caps to at least one of the outer covering, hook fabric, and tube along each longitudinal edge of the tube to form a ponytail holder. The assembled ponytail holder is configured for placement around at least a constricted area of a bundle of hair and over an existing elastic band that surrounds the bundle and forms the constricted area. The hook fabric is configured to mate with the existing elastic band in conjunction with placement of the assembled apparatus around the bundle such that the outer covering adorns the bundle of hair and the existing elastic band is obscured from view.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention exists in the construction, arrangement, and combination of the various parts of the device, and steps of the method, whereby the objects contemplated are attained as hereinafter more fully set forth, specifically pointed out in the claims, and illustrated in the accompanying drawings in which:

FIG. 1 is a perspective drawing of an exemplary embodiment of a ponytail holder;

FIGS. 2A-F show six additional views of the exemplary embodiment of the ponytail holder of FIG. 1;

FIG. 3 is a perspective drawing of another exemplary embodiment of a ponytail holder;

FIGS. 4A-F show six additional views of the exemplary embodiment of the ponytail holder of FIG. 3 in a closed position;

DETAILED DESCRIPTION

Figure 5A:
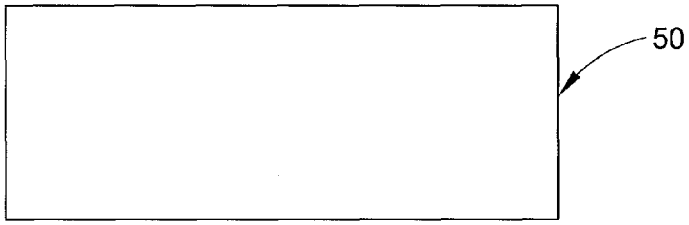
FIGS. 5A-F show six additional views of the exemplary embodiment of the ponytail holder of FIG. 3 in an open, flattened position.
Figure 5B:
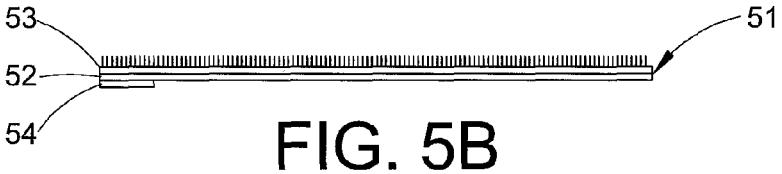
Figures 5C, 5D, 5E:
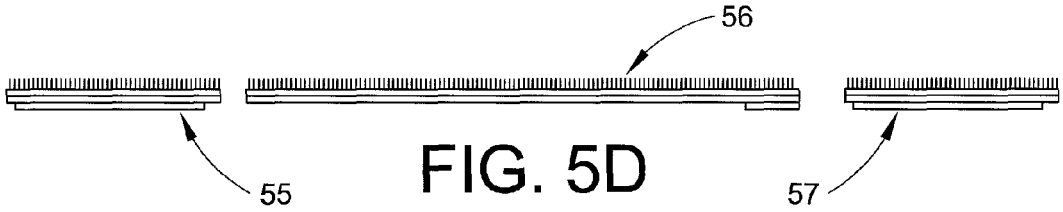
Figure 5F:
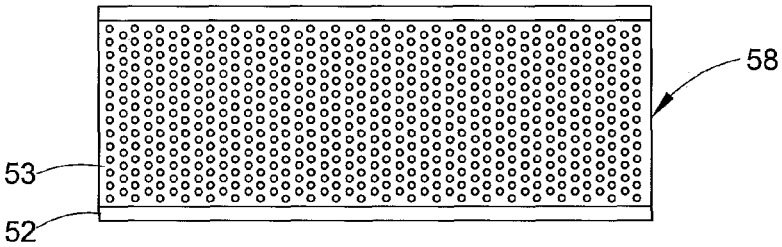

With reference to FIG. 1, an exemplary embodiment of a ponytail holder includes an outer covering 10, a tube 11 with outer and inner surfaces, and a hook fabric 12 with a hook surface. A longitudinal slit 14 in the tube 11 forms opposing longitudinal edges 13. The outer covering 10 is secured to the outer surface of the tube 11. The hook fabric 12 is secured to the inner surface of the tube 11 such that the hook surface faces away from the tube 11. The circumference, width, structure, surface texture, thickness, color, edge-detail, shape, and other dimensions and characteristics of the ponytail holder and its components may vary.

Figure 12A:
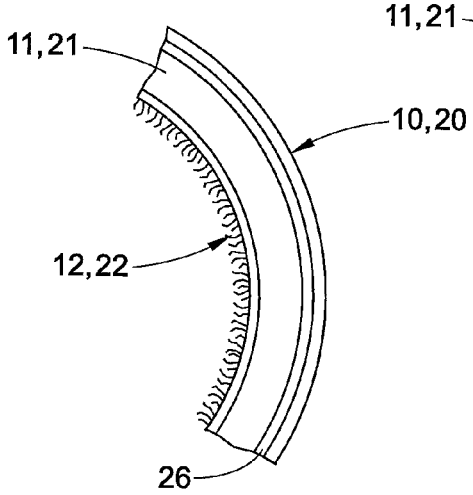
FIGS. 12A-H show enlarged cross sectional and perspective views of the exemplary embodiment of the ponytail holder of FIGS. 1 and 2B.
Figure 12B:
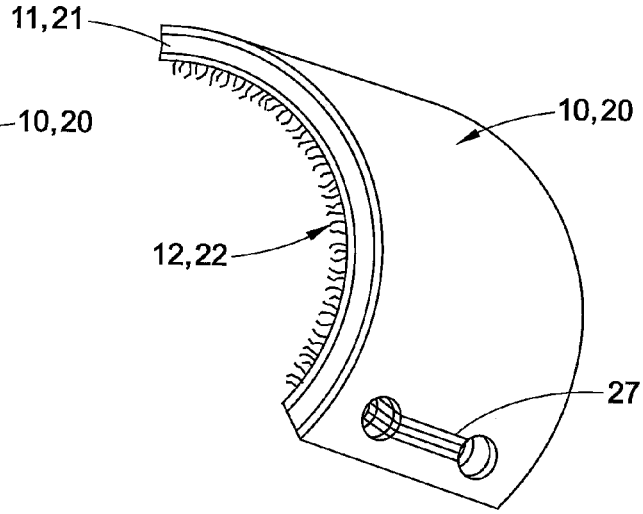
Figure 12C:
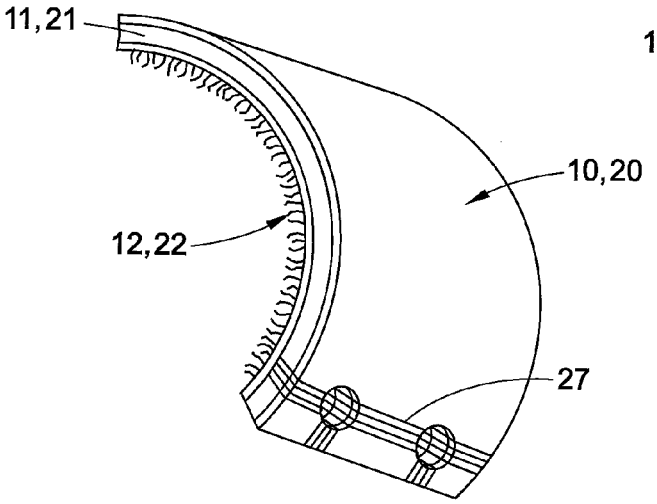
Figure 12D:
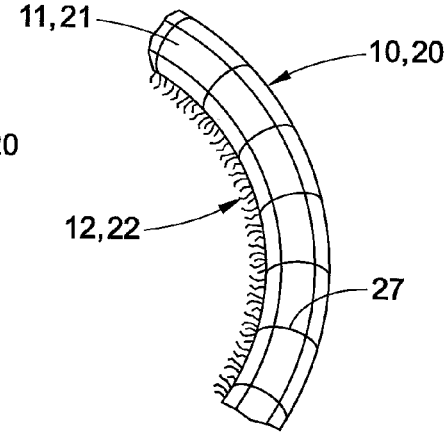
Figure 12E:
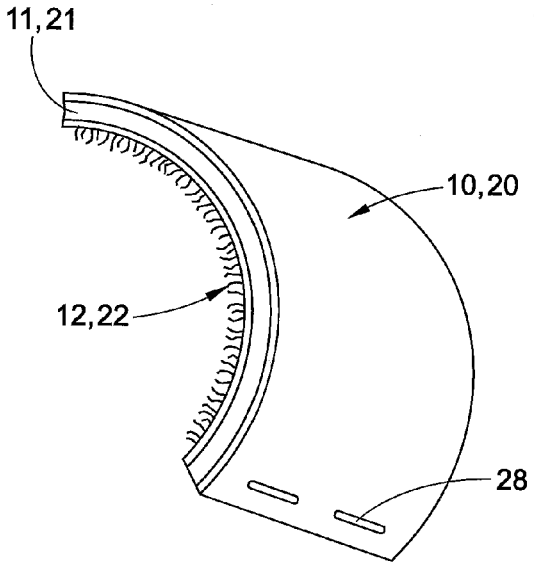
Figure 12F:
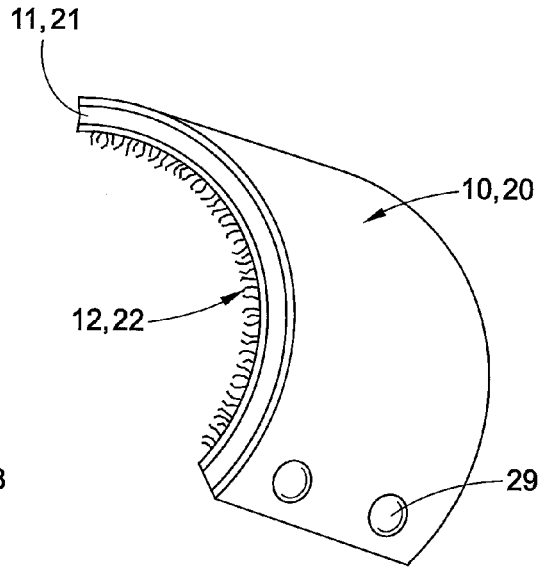
Figure 12G:
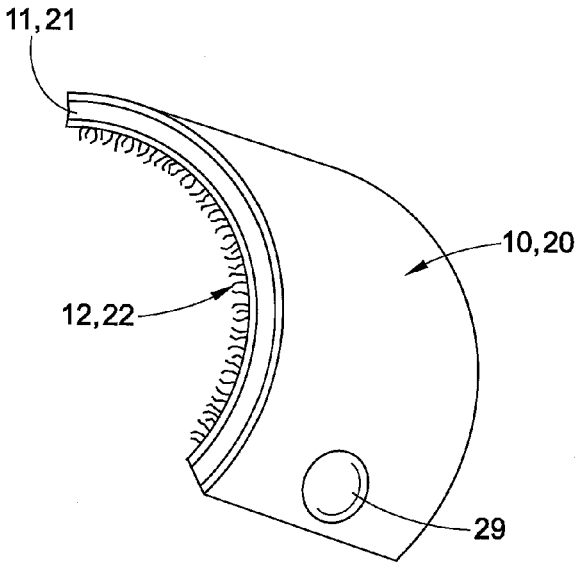

The outer covering 10 may be secured to the outer surface of the tube 11 using glue 26 (see FIG. 12A), tape 26 (see FIG. 12A), thread 27 (see FIGS. 12B-D), string 27 (see FIGS. 12B-D), wire 27 (see FIGS. 12B-D), staples 28 (see FIG. 12E), rivets (see FIGS. 12F-G), or any suitable attaching material in any suitable combination. The outer covering 10 may include fabric, leather, vinyl, beading, or any other suitable material in any suitable combination. The outer covering 10 conforms to the tube 11 and moves with the tube 11 when the tube 11 is flexed in conjunction with placement and removal of the ponytail holder on a ponytail or another object adorned by the ponytail holder. The outer covering 10 may be painted, stained, colored, or marked with any suitable coating or marking material. The outer covering 10 and tube 11 may be pierced, notched, punched, shaped, or scalloped in any suitable combination. The outer covering 10 may be decorated with any suitable accessories.

In another embodiment, the outer covering 10 may include the outer surface of the tube 11. Where the outer covering 10 includes the outer surface of the tube 11, the outer covering 10 may simply be the color and texture of the tube 11. Alternatively, the outer surface of the tube 11 may be painted, stained, colored, or marked with any suitable coating or marking material in any suitable combination to form the outer covering 10. Likewise, the outer surface of the tube 11 may be pierced, notched, punched, shaped, or scalloped in any suitable combination to form the outer covering 10. Additionally, the outer surface of the tube 11 may be decorated with any suitable accessories to form the outer covering 10. Unless the outer covering 10 is simply the outer surface of the tube 11, any combination of coating or marking material and accessories forms the outer covering 10 on top of the outer surface of the tube 11.

The outer covering 10 may be wrapped around the sides of the tube 11 and secured to an inner surface of the tube 11. Likewise, the outer covering 10 may be wrapped around the longitudinal edges 13 of the tube 11 and secured to the inner surface. The wrapped around portions of the outer covering 10 may be secured to the inner surface of the tube 11 using glue 26 (see FIG. 12A), tape 26 (see FIG. 12A), thread 27 (see FIGS. 12B-D), string 27 (see FIGS. 12B-D), wire 27 (see FIGS. 12B-D), staples 28 (see FIG. 12E), rivets 29 (see FIGS. 12F-G), or any suitable attaching material in any suitable combination. Portions of the outer covering 10 proximate to or wrapped around the opposing longitudinal edges 13 may be covered with corresponding end caps 15 to secure the outer covering 10 to the tube 11 and give the longitudinal edges 13 a more finished appearance. The end cap 15 may be made of plastic, metal, or any suitable material that will hold the outer covering 10 in place. Each end cap 15 may be crimped in place or secured to the combined outer covering 10 and tube 11 at the corresponding longitudinal edge 14 using glue, tape, thread, string, wire, staples, rivets, or any suitable attaching material in any suitable combination.

The tube 11 provides stiffness and flexibility. The tube 11 can be flared open or deformed by separating the opposing longitudinal edges 13. The tube 11 is biased to generally return to its original form when the opposing longitudinal edges 13 are released. The tube 11 may include plastic or any other suitable material. The longitudinal slit 14 allows insertion of the ponytail or another object that the ponytail holder may adorn (other uses may be possible and are described later). The opposing longitudinal edges 13 of the tube 11 can be separated to place the ponytail holder around the ponytail and over the elastic band. After insertion of the ponytail, the longitudinal edges 13 are released and the tube 11 approximates its original shape.

The hook fabric 12 may be adhesive-backed or secured to the inner surface of the tube 11 using glue, tape, thread, string, wire, staples, rivets, or any suitable attaching material in any suitable combination. The hook fabric 12 and the loop fabric referred to below are related to hook-and-loop fasteners such as those commercially marketed by Velcro Industries B.V. of Amsterdam, The Netherlands. Hook-and-loop fasteners include a hook fabric and a loop fabric attached to two separate surfaces for fastening the surfaces together. The hook fabric includes tiny hooks on a hook surface. The loop fabric includes even smaller loops on a loop surface. The hook surface mates with the loop surface such that when the hook and loop fabrics are pressed together, the hooks catch and embed themselves in the loops and the two fabrics fasten or bind temporarily.

When the ponytail holder is worn, hooks in the hook fabric 12 adhere to, for example, a commercially-available elastic band that has been pre-placed, for example, in a person's hair to form a ponytail. The elastic band in this example is made of material (or covered with material) that mates with the hook fabric 12 much like loop fabric mates with hook fabric. The mating of the hook fabric 12 with the elastic band stabilizes the ponytail holder and keeps it in place, even when the wearer is very active. The hook fabric 12 is normally not visible when the ponytail holder is worn.

Figure 12H:
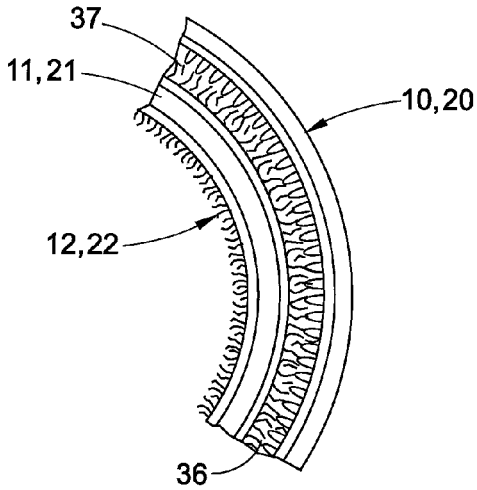

In an alternate embodiment, the outer covering 10 may be secured to the outer surface of the tube 11 by applying hook fabric 36 (see FIG. 12H) to the outer surface (hidden) of the tube 11, applying loop fabric 37 (see FIG. 12H) to an inner surface (hidden) of the outer covering 10, and pressing the outer covering 10 on the tube 11 to mate the loop and hook fabrics 36, 37. The hook fabric 36 (see FIG. 12H) applied to the outer surface of the tube 11 may be adhesive-backed or may be secured to the tube using glue 26 (see FIG. 12A), tape 26 (see FIG. 12A), thread 27 (see FIGS. 12B-D), string 27 (see FIGS. 12B-D), wire 27 (see FIG. 12B-D), staples 28 (see FIG. 12E), rivets 29 (see FIGS. 12F-G), or any suitable attaching material in any suitable combination. The loop fabric 37 (see FIG. 12H) applied to the inner surface of the outer covering 10 may be adhesive-backed or may be secured to the outer covering 10 using glue 26 (see FIG. 12A), tape 26 (see FIG. 12A), thread 27 (see FIGS. 12B-D), string 27 (see FIGS. 12B-D), wire 27 (see FIGS. 12B-D), staples 28 (see FIG. 12E), rivets 29 (see FIGS. 12F-G), or any suitable attaching material in any suitable combination. Hook and loop attachment of the outer covering 10 to the tube 11 allows for substitution of outer coverings 10 on the tube 11 so that, for example, alternate colors, patterns, and fanciful designs for outer coverings 10 can be used with the same tube 11.

With reference to FIGS. 2A-F, six additional views of the exemplary embodiment of the ponytail holder of FIG. 1 are shown, including top, left, front, right, back, and bottom views. For example, the front view shows an aperture formed by the ponytail holder which may enclose a ponytail or another object. In all views, one can see the outer covering 20. The front view shows the outer covering 20 on the outer surface of the tube 21. The hook fabric 22 is secured to the inner surface of the tube 21. The hook fabric 22 allows the ponytail holder to adhere to a commercially-available elastic band ponytail holder that has been pre-placed by the wearer. Optional end caps 23 give a finished appearance to the longitudinal edges formed by the longitudinal slit 24 in the tube 21. In the bottom view, the end caps 23 are visible. The longitudinal slit 24 reveals the hook fabric 22 on the inner surface of the tube 21.

With reference to FIG. 3, another exemplary embodiment of a ponytail holder includes an outer covering 30 with front and back surfaces and a hook fabric 31 with a hook surface. The back surface of the outer covering 30 is secured to the hook fabric 31 such that with the hook surface faces away from the outer covering 30. The outer covering 30 and hook fabric 31 form a ribbon-like strip with opposing ends 32. For example, the hook surface may be slightly smaller than the outer covering. The ponytail holder may also include a fastening mechanism with mating fastener components secured to the opposing ends 32. In one embodiment, the fastener components may include one or more wire segments disposed between the outer covering 30 and the hook fabric 31. A suitable closing device may be may be used in conjunction with the embedded wire to maintain the shape of the ponytail holder when worn. The circumference, width, structure, surface texture, thickness, color, edge-detail, shape, and other dimensions and characteristics of the ponytail holder and its components may vary.

The hook fabric 31 may be adhesive-backed or the outer covering 30 may be secured to the hook fabric 31 using glue, tape, thread, string, wire, staples, rivets, or any suitable attaching material in any suitable combination. The outer covering 30 may include fabric, leather, vinyl, beading, or any other suitable material in any suitable combination. The outer covering 30 conforms to the hook fabric 31 and moves with the hook fabric 31 when the hook fabric 31 is flexed in conjunction with placement and removal of the ponytail holder on a ponytail or another object adorned by the ponytail holder. The outer covering 30 may be painted, stained, colored, or marked with any suitable coating or marking material. The outer covering 30 and hook fabric 31 may pierced, notched, punched, shaped, or scalloped in any suitable combination. The outer covering 30 may be decorated with any suitable accessories.

The outer covering 30 may be wrapped around the hook fabric 31 at one or more opposing end 32 and secured to the hook surface. The wrapped around portions of the outer covering 30 may be secured to the hook surface of the hook fabric 31 using glue, tape, thread, string, wire, staples, rivets, or any suitable attaching material in any suitable combination. Portions of the outer covering 30 proximate to or wrapped around one or more opposing end 32 may be covered with an end cap to secure the outer covering 30 to the hook fabric 31 and give the corresponding end 32 a more finished appearance. The end cap may be made of plastic, metal, or any suitable material that will hold the outer covering 30 in place. Each end cap may be crimped in place or secured to the outer covering 30 at the corresponding end 32 using glue, tape, thread, string, wire, staples, rivets, or any suitable attaching material in any suitable combination.

The hook fabric 31 provides stiffness and flexibility. The hook fabric 31 also prevents fraying or unraveling of the outer covering 30. The hook fabric 31 and the loop fabric referred to below are related to hook-and-loop fasteners such as those commercially marketed by Velcro Industries B.V. of Amsterdam, The Netherlands.

The fastening mechanism may include a loop fabric 33 secured to the front surface of the outer covering 30 at a first end 32. The hook fabric 31 may extend to the other end 32. The loop fabric 33 may be adhesive-backed or secured to the front surface of the outer covering 30 using glue, tape, thread, string, wire, staples, rivets, or any suitable attaching material in any suitable combination. The loop fabric 33 may extend along the entire width of the outer covering 30. The opposing end 32 can be pressed over the first end 32 to mate the hook fabric 31 with the loop fabric 33 to hold the ponytail holder in a closed position around a ponytail or another object adorned by the ponytail holder.

When the ponytail holder is worn, hooks in the hook fabric 31 adhere to, for example, a commercially-available elastic band that has been pre-placed, for example, in a person's hair to form a ponytail. The elastic band in this example is made of material (or covered with material) that mates with the hook fabric 31 much like loop fabric mates with hook fabric. The mating of the hook fabric 31 with the elastic band stabilizes the ponytail holder and keeps it in place, even when the wearer is very active. The hook fabric 31 is normally not visible when the ponytail holder is worn.

With reference to FIGS. 4A-F, six additional views of the exemplary embodiment of the ponytail holder of FIG. 3 are shown, including top, left, front, right, back, and bottom views. For example, the front view shows the ponytail holder with loop fabric 42 pressed together with the hook fabric 41 at mating ends 43 to form an aperture. For example, the aperture may enclose a ponytail or another object. The front view also shows the outer covering 40 directly on the hook fabric 41. The hook fabric 41 functions to secure the ponytail holder to a pre-placed commercially-available elastic band. The hook fabric 41 also provides some stiffness to support the outer covering 40 and prevents fraying of the outer covering 40. The right view shows how the loop fabric 42 extends across the width of the ponytail holder to keep it in the closed position when worn. Other types of fastening mechanisms may be used, including snaps, hooks, lengths of elastic, and ties.

With reference to FIGS. 5A-F, six additional views of the exemplary embodiment of the ponytail holder of FIG. 3 are shown in an opened, flattened position, including a top view 50, a front view 51, a left view 55, a back view 56, a right view 57, and a bottom view 58. For example, the front view shows the outer covering 52, hook fabric 53, and loop fabric 54 of the ponytail holder in the opened, flattened position. The outer covering 52 is secured directly to the hook fabric 53. The hook fabric 53 extends very close to edges of the outer covering 52. The loop fabric 53 is used to form an aperture to enclose a ponytail or another object by adhering to the hook fabric 53 when the ponytail holder is in the closed position.

Figure 6A:
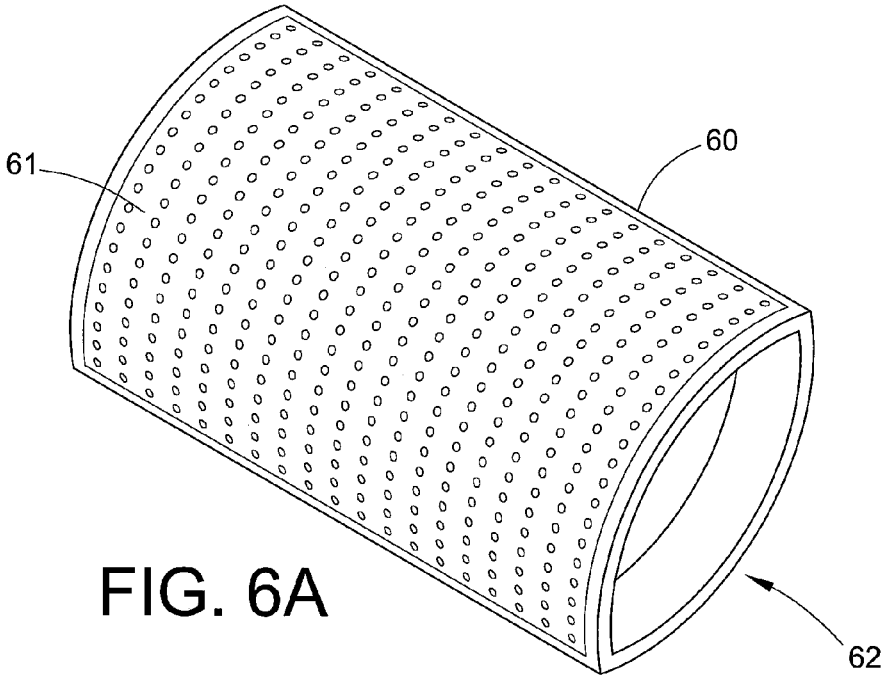
FIGS. 6A-B are perspective drawings of still another exemplary embodiment of a ponytail holder and a perspective view of an exemplary outer covering for the ponytail holder.
Figure 6B:
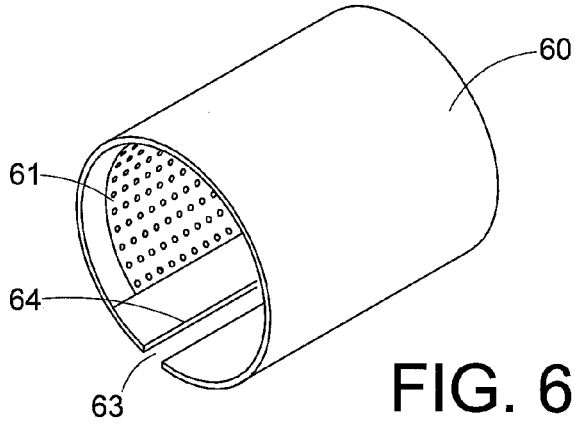

With reference to FIGS. 6A-B, still another exemplary embodiment of a ponytail holder includes an outer covering 60 with front and back portions, a hook fabric 61 with a hook surface, and a tube. The front and back portions of the outer covering 60 form a sleeve 62 with opposing open ends. The hook fabric 61 is secured to the back portion of the outer covering 60 such that with the hook surface faces away from the outer covering 60. A longitudinal slit 63 in the tube forms opposing longitudinal edges 64. The combined outer covering 60 and hook fabric 61 is configured to slide over the tube by feeding a longitudinal edge 64 through the sleeve 62 until both longitudinal edges 64 are covered. The circumference, width, structure, surface texture, thickness, color, edge-detail, shape, and other dimensions and characteristics of the ponytail holder and its components may vary.

The outer covering 60 may include fabric, leather, vinyl, beading, or any other suitable material in any suitable combination. The outer covering 60 conforms to the tube and moves with the tube when the tube is flexed in conjunction with placement and removal of the ponytail holder on a ponytail or another object adorned by the ponytail holder. The outer covering 60, particularly the front portion, may be painted, stained, colored, or marked with any suitable coating or marking material. The outer covering 60, hook fabric 61, and tube may be pierced, notched, punched, shaped, or scalloped in any suitable combination. The outer covering 60 may be decorated with any suitable accessories.

The outer covering 60 may include a piece of material with mating sides that are secured together to form the sleeve 62. In another embodiment, the outer covering 60 may include multiple pieces of material that are arranged and secured together to form the sleeve 62. One end of the sleeve 62 may be closed by securing the front and back portions of the outer covering 60 together at that end. In this embodiment, the outer covering 60 forms a pocket defined by the sleeve 62, the closed end, and the opening at the opposite end. After the outer covering 60 is slid on the tube and both longitudinal edges 64 are covered, the open end(s) of the sleeve may be closed by securing the front and back portions of the outer covering 60 together at that end. The material of the outer covering 60 may be secured together using glue, tape, thread, string, wire, staples, rivets, or any suitable attaching material in any suitable combination to form the sleeve 62 and to close one or both ends of the sleeve.

One or more end of the sleeve 62 may be covered with an end cap to secure the front and back portions of the outer covering 60 together at that end and give the corresponding end a more finished appearance. The end cap may be made of plastic, metal, or any suitable material that will hold the front and back portions of the outer covering 60 in place. Each end cap may be crimped in place or secured to the outer covering 60 at the corresponding end of the sleeve 62 using glue, tape, thread, string, wire, staples, rivets, or any suitable attaching material in any suitable combination.

The hook fabric 61 may be adhesive-backed or secured to the outer covering 60 using glue, tape, thread, string, wire, staples, rivets, or any suitable attaching material in any suitable combination. The hook fabric 61 and the loop fabric referred to below are related to hook-and-loop fasteners such as those commercially marketed by Velcro Industries B.V. of Amsterdam, The Netherlands.

The tube provides stiffness and flexibility. The tube can be flared open or deformed by separating the opposing longitudinal edges 64. The tube is biased to generally return to its original form when the opposing longitudinal edges 64 are released. The tube may include plastic or any other suitable material. The opposing longitudinal edges 64 can be spread apart to facilitate sliding the sleeve 62 over the tube. When the sleeve 62 is in place the tube is covered and not visible, as the outer covering 60 covers both longitudinal edges 64. The longitudinal slit 63 allows insertion of the ponytail or another object that the ponytail holder may adorn (other uses may be possible and are described later). The opposing longitudinal edges 64 of the tube can be separated to place the ponytail holder around the ponytail and over the elastic band. After insertion of the ponytail, the longitudinal edges 64 are released and the tube approximates its original shape.

When the ponytail holder is worn, hooks in the hook fabric 61 adhere to, for example, a commercially-available elastic band that has been pre-placed, for example, in a person's hair to form a ponytail. The elastic band in this example is made of material (or covered with material) that mates with the hook fabric 61 much like loop fabric mates with hook fabric. The mating of the hook fabric 61 with the elastic band stabilizes the ponytail holder and keeps it in place, even when the wearer is very active. The hook fabric 61 is normally not visible when the ponytail holder is worn.

Figure 7A:
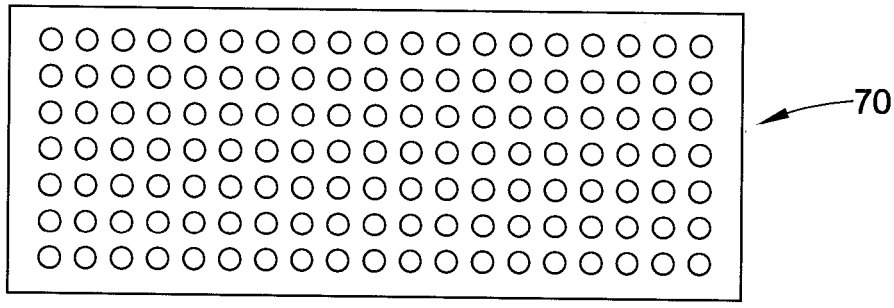
FIGS. 7A-C show top views of three exemplary embodiments of tubes in which the tubes are flattened out for illustrative purposes.
Figure 7B:
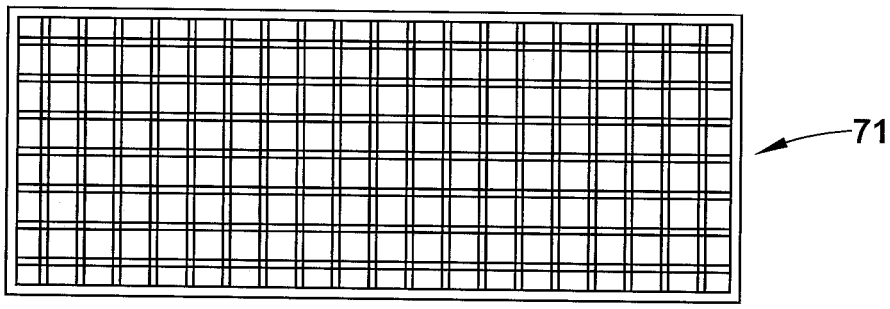
Figure 7C:
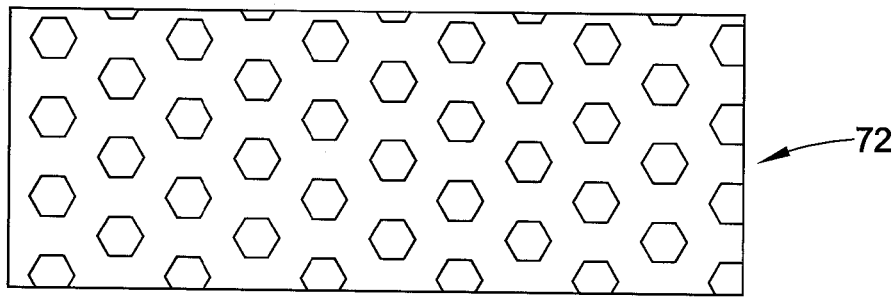

With reference to FIGS. 7A-C, top views of three exemplary embodiments of tubes are shown in which the tubes are flattened out for illustrative purposes. For example, in one embodiment, the tube 70 may include a series of holes through which various add-ons, such as decorations with a stud and backing similar to a pierced earring, can be inserted. In another embodiment, the tube 71 may include mesh plastic material to allow such add-ons and to further reduce the weight of the ponytail holder. The mesh plastic material may incorporate variations in shape, such as a medallion-like shape. In yet another embodiment, the outer surface of the tube 72 may be decorative. This eliminates the need for a separate fabric-like decorative outer covering. The tube 72 may come in various colors and with a variety of embedded textures configured into the outer surface. The sides and/or ends of the tube 72 do not necessarily need to be straight and may include a variety of shapes, such as scallops or waves.

Figure 8:
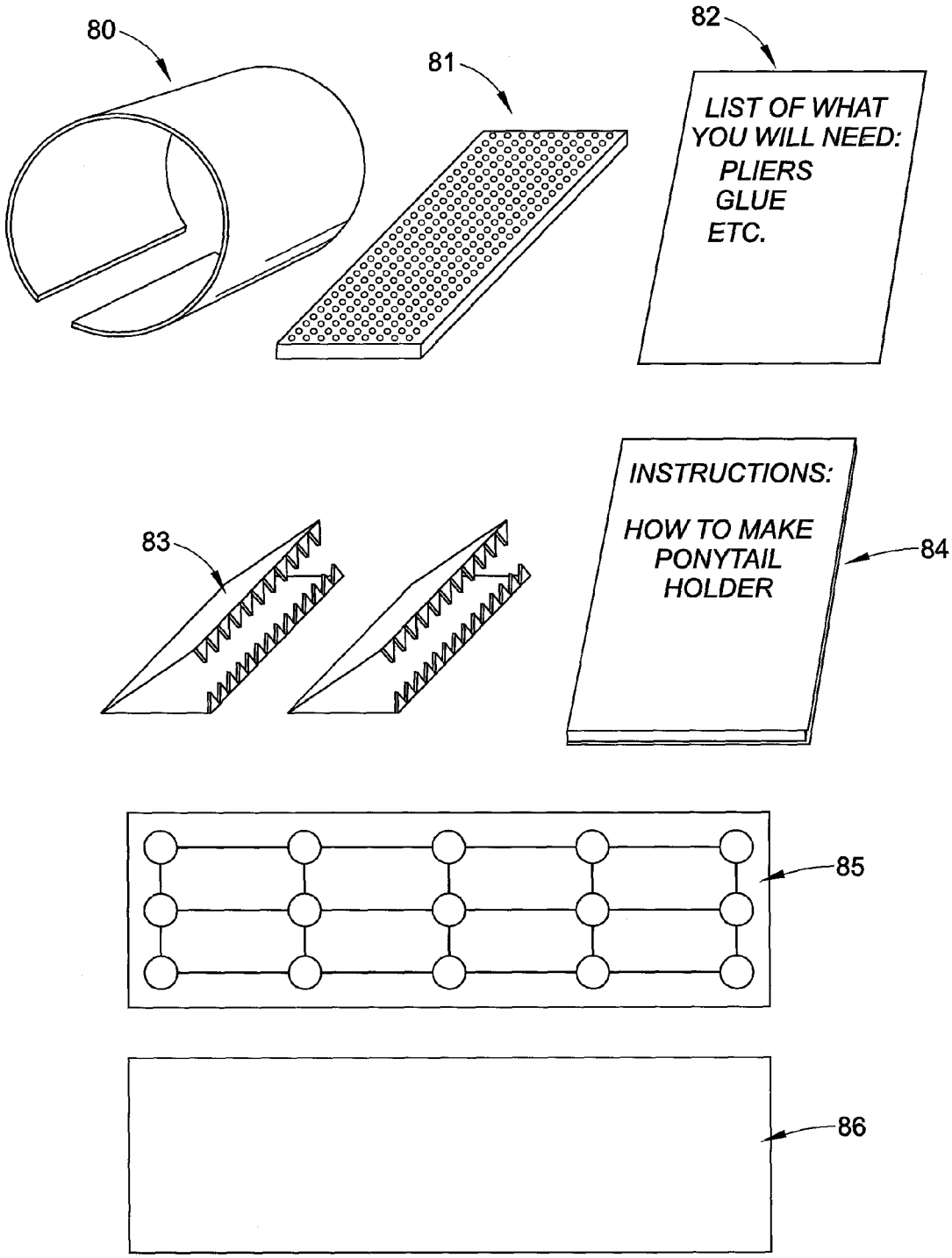
FIG. 8 is a drawing of an exemplary embodiment of a kit for making an exemplary ponytail holder.

With reference to FIG. 8, an exemplary embodiment of a kit for making an exemplary ponytail holder includes a tube 80, a loop fabric 81, and two end caps 83. The kit may also include an outer covering 86 and/or a template 85 to assist in accurately marking and cutting an outer covering from a separately-obtained stock material. Additionally, the kit may include a list 82 of additional items needed to make the ponytail holder, such as pliers and/or other tools and glue and/or other materials. The kit may also include instructions 84 for making the ponytail holder. Kitting parts for making the ponytail holder may be implemented in an overall manufacturing process for making ponytail holders as consumer products. Moreover, ponytail holder kits may be sold to consumers for craft projects allow people to make ponytail holders for personal use, gifting, or selling.

Figure 9A:
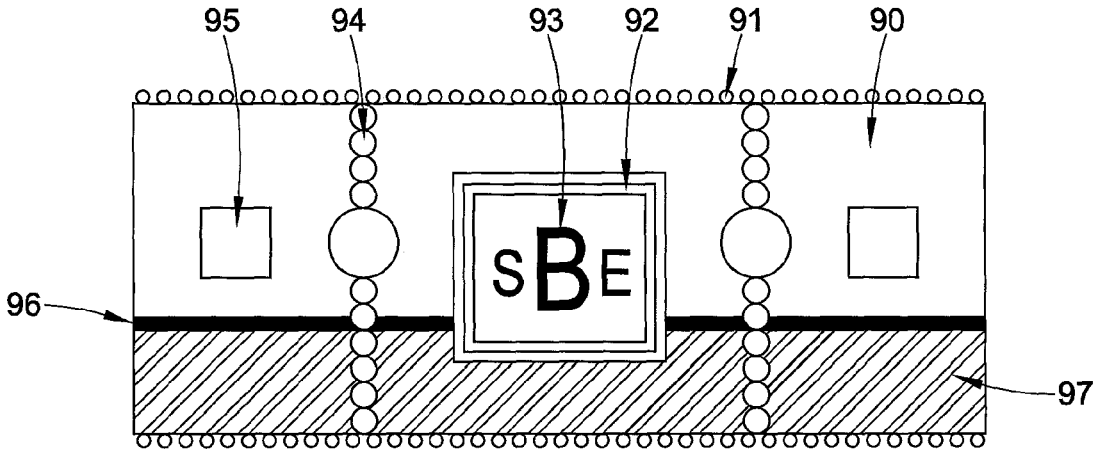
FIGS. 9A-B show top and side views of still yet another exemplary embodiment of a ponytail holder, the top view shows the ponytail holder at least partially flattened out for illustrative purposes.
Figure 9B:
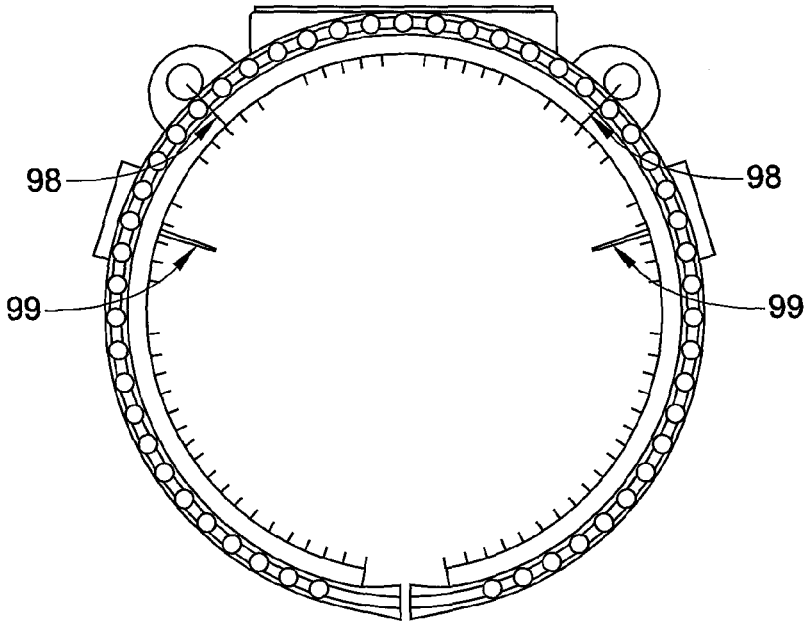

With reference to FIGS. 9A-B, still yet another exemplary embodiment of a ponytail holder with various exemplary optional add-ons is shown in a top view and a side view. The top view shows a central half of the ponytail holder flattened out to illustrate the add-ons. The outer covering 90/97 may include one or more type of covering materials, surfaces, and coatings in any suitable combination. Many add-ons are possible to embellish the ponytail holder. Add-ons may be applied to the ponytail holder, particularly to the outer covering using glue, tape, thread, string, hook and loop fabric, wire, staples, rivets, elastic banding, studs or any suitable attaching material in any suitable combination. A decorative trim 91 may be formed into the side of the tube 98 or applied to the side edge portions of the tube 98 and/or outer covering 90, 97. The decorative trim 91 may also have additional beading, tassels, or other hanging/dangling elements that may further enhance the appearance of the ponytail holder. The center top portion of the ponytail holder may have a focal point 93 with a background element 92. The types of focal point options are endless. A few types of focal point options include initials, sports emblems, animals, team logos, names, Greek letters, and more. Another add-on can be a string of beads 94 which can be glued to the surface or made to surround the width of the tube 98 as shown. A stud-type add-on 95 would be similar to a studded earring. The stud 99 pierces the outer covering 90, 97 and the stud-type add-on 95 is secured to the ponytail holder by a backing. A line of ribbon or welting 96 can also enhance the appearance of the ponytail holder.

Figure 10A:
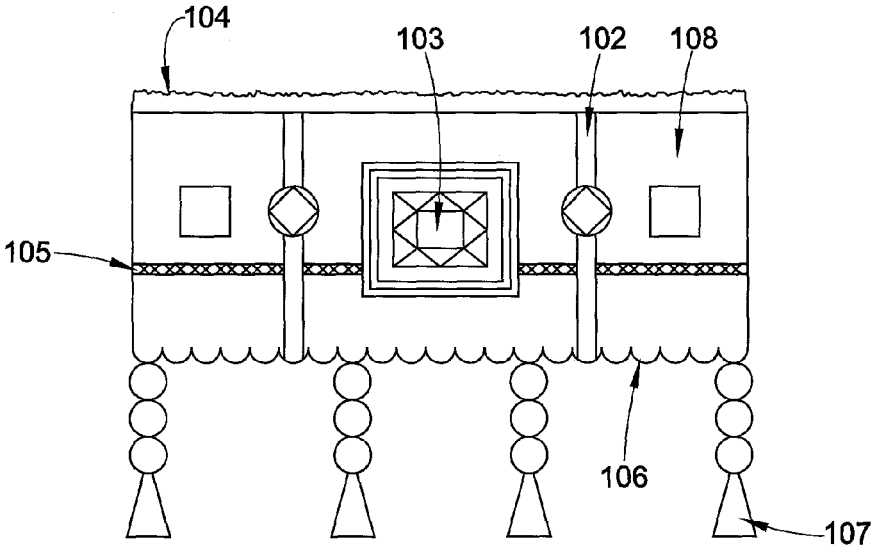
FIG. 10A is a top view of another exemplary embodiment of a ponytail holder in which the ponytail holder is at least partially flattened out for illustrative purposes.
Figure 10B:
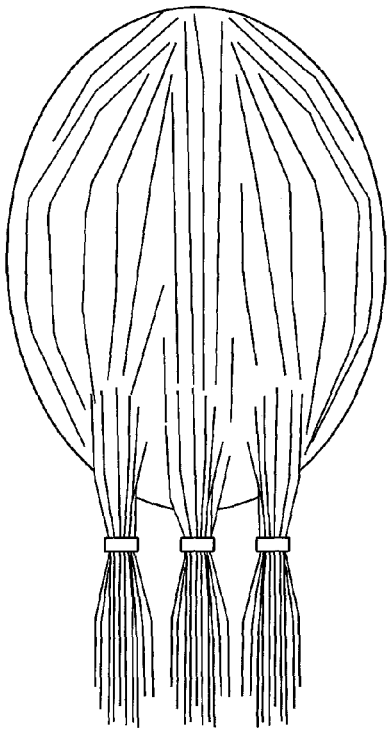
FIG. 10B is a back of head view before the ponytail holder is in place.
Figure 10C:
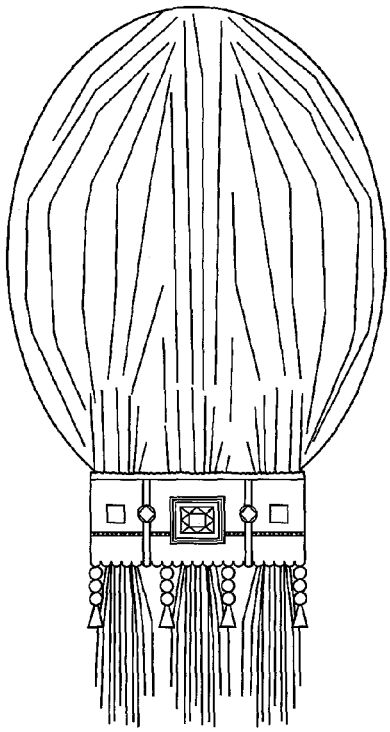
FIG. 10C is a back of head view after the ponytail holder is in place.

With reference to FIG. 10A, another exemplary embodiment of a ponytail holder with various exemplary optional add-ons is shown in a top view. The top view shows a central half of the ponytail holder flattened out to illustrate the add-ons. This exemplary ponytail holder shows more possibilities for embellishments to enhance the appearance. For example, a fabric ruffle 104 adorns the upper edge of the ponytail holder. The outer covering 101 may be paint or another suitable coating applied to an outer surface of the tube. For example, a coating of silver leafing could be applied to the tube. In this exemplary ponytail holder, a ribbon 102 with a circular icon has been attached to the ponytail holder. A real or faux gem could be attached as a focal point 103. Even real or faux hair 105 can be added to embellish the ponytail holder. Shaped edges 106 or dangling beads and/or tassels 107 are some of the many possibilities of add-ons to the ponytail holder. This exemplary ponytail holder is also shown as it would be worn, in place, on the back lower part of the wearer's head. The "before" view (see FIG. 10B) of the wearer's head shows three ponytails with elastic bands. The "after" view (see FIG. 10C) of the wearer's head shows the oval-shaped ponytail holder in place around the three ponytails and over the elastic bands.

Figure 11A:
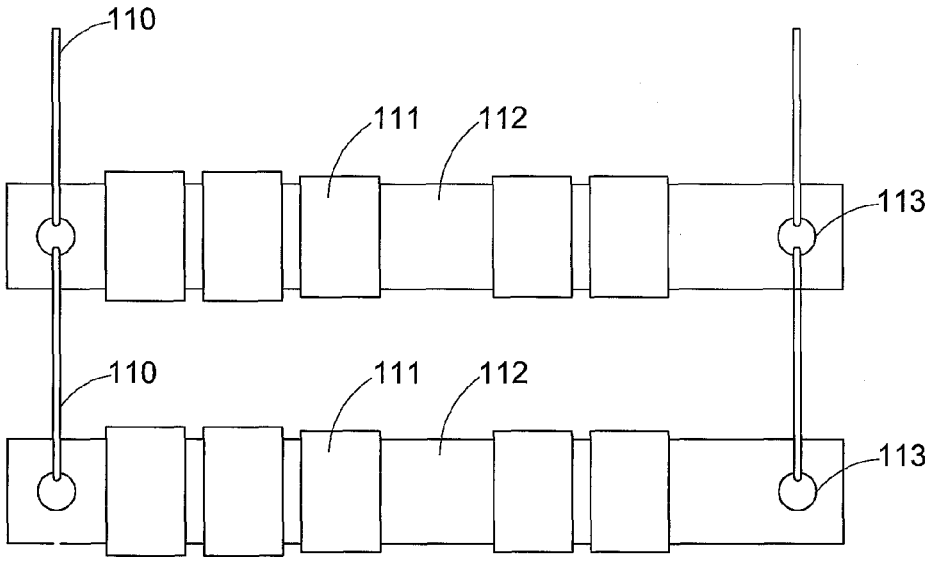
FIGS. 11A-B show front and side views of an exemplary embodiment of a storage device for ponytail holders.
Figure 11B:
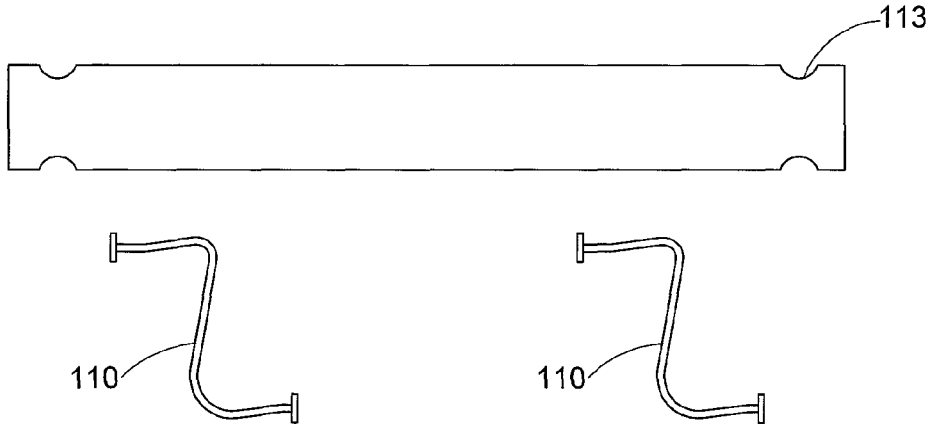

With reference to FIGS. 11A-B, an exemplary embodiment of a storage device for ponytail holders 111 includes at least one chain 110 and at least one tube 112. At least one chain 110 is secured to each tube 112 at an end portion of the corresponding tube 112. Each chain 110 forms a loop that can be selectively opened and closed. Each tube 112 is sized to receive a plurality of ponytail holders 111, such as the ponytail holders described in FIGS. 1-10. The storage device is configured to be suspended from a hanger or hook.

In one embodiment, the storage device is configured to be suspended from by a first chain 110 secured to an end portion of a first tube 112. In this embodiment, the storage device is configured such that the first tube 112 hangs vertically when the storage device is suspended by the first chain 110. In a further embodiment, the storage device also includes a second chain 110 and a second tube 112. The first and second chains 110 are secured at opposing end portions of the first tube 112. The second chain 110 is also secured to an end portion of the second tube 112. In this embodiment, the storage device is configured such that the first and second tubes 112 hang vertically when the storage device is suspended by the first chain 110.

In another embodiment, the storage device also includes a second chain 110 secured to the first tube 112. The first and second chains 110 are secured to opposing end portions of the first tube 112. In this embodiment, the storage device is configured such that the first tube 112 hangs horizontally when the storage device is suspended by the first and second chains 110. In a further embodiment, the storage device also includes third and fourth chains 110 and a second tube 112. The third and fourth chains 110 are secured at opposing end portions of the first and second tubes 112. In this embodiment, the storage device is configured such that the first and second tubes 112 hang horizontally when the storage device is suspended by the first and second chains 110.

Each chain 110 may include a length of bead chain or any suitable type of chain and a coupling or any suitable chain component that permits the loop of chain to be opened and closed. The end portions of each tube 112 may include pre-drilled holes 113 configured to receive the corresponding chain 110. Each chain 112 may be secured to the end portion(s) of the corresponding tube(s) 112 by opening the loop formed by the chain 110, feeding the chain 110 through the pre-drilled hole 113 in the corresponding end portion(s), and closing the loop formed by the chain 110.

Ponytail holders 111 can be stored on the storage device by being placed on the tube 112. The storage device can be suspended from any suitable hanger or hook supplied by a wearer of the ponytail holders or another person. As described above, additional chains and tubes can be interconnected to form a ladder-like storage device having horizontal "rungs" (i.e., tubes) or a rope-like storage device having vertical "segments" (i.e., tubes). The "rungs" or "segments" can be detached by opening the corresponding chains 110. For example, a detached tube 112 can be used to store ponytail holders and keep them in their proper shape for travel.

Other uses for the ponytail holder, beyond using it to hold a ponytail, are envisioned. For example, various embodiments of the ponytail holder described herein could be used as uniquely decorated identifiers for personal items, such as suitcases, briefcases, school items, golf bags, or other personal items. Various embodiments of the ponytail holder described herein could also be used for interior design and home décor, such as for drapery holdbacks, napkin rings, and pillow accents. Additionally, various embodiments of the ponytail holder described herein could be used for decorative adornments for pets, such as pet collars or tail adornments. Various embodiments of the ponytail holder described herein could also be used for adornment of toys, such as for hair and other adornments of dolls. Additionally, various embodiments of the ponytail holder described herein could be used for other types of adornment for the body, such as bracelets, belts, etc. The size and shape of the tube would be altered to suit the intended purpose for the ponytail holder. For example, the shape of the tube in longitudinal cross-section could be round-like, oval-like, or any other suitable shape.

The above description merely provides a disclosure of particular embodiments of the invention and is not intended for the purposes of limiting the same thereto. As such, the invention is not limited to only the above-described embodiments. Rather, it is recognized that one skilled in the art could conceive alternative embodiments that fall within the scope of the invention.

I claim:

1. An apparatus for adorning a ponytail, comprising:

an outer covering including a front surface, the outer covering having a select width and a select length and configured to adorn at least a constricted area of a bundle of hair;

an interior hook fabric including a hook surface, the interior hook fabric having width and length dimensions that do not exceed the select width and select length of the outer covering, wherein the interior hook fabric is assembled with the outer covering such that the hook surface of the interior hook fabric faces away from the outer covering and the front surface of the outer covering faces away from the interior hook fabric; and a tube including inner and outer surfaces and a longitudinal slit forming opposing longitudinal edges, the tube sized in relation to the outer covering and the constricted area of the bundle of hair to be adorned;

wherein the assembled outer covering and interior hook fabric is configured for placement around the bundle and over an existing elastic band that surrounds the bundle and forms the constricted area;

wherein the interior hook fabric is configured to mate with the existing elastic band in conjunction with placement of the assembled outer covering and interior hook fabric around the bundle such that the outer covering adorns the bundle of hair and the existing elastic band is obscured from view;

wherein the interior hook fabric is secured to the inner surface of the tube such that the hook surface of the interior hook fabric faces away from the tube;

wherein the tube is configured to receive the constricted area of the bundle of hair through the longitudinal slit in conjunction with placement of the assembled outer covering, interior hook fabric, and tube around the bundle;

wherein the outer covering is secured to the outer surface of the tube such that the front surface of the outer covering faces away from the tube;

wherein the outer covering is removably secured to the outer surface of the tube using at least one of glue, tape, thread, string, wire, staples, rivets, and a hook-and-loop fastener, the hook-and-loop fastener including a hook portion secured to the outer surface of the tube and a loop portion secured to a back surface of the outer covering.

2. The apparatus of claim 1 wherein the hook surface of the interior hook fabric is configured to mate with an exterior surface of the existing elastic band in a hook-and-loop fastening manner in conjunction with placement of the assembled outer covering and interior hook fabric around the bundle.

3. An apparatus for adorning a ponytail, comprising:

an outer covering including a front surface, the outer covering having a select width and a select length and configured to adorn at least a constricted area of a bundle of hair;

an interior hook fabric including a hook surface, the interior hook fabric having width and length dimensions that do not exceed the select width and select length of the outer covering, wherein the interior hook fabric is assembled with the outer covering such that the hook surface of the interior hook fabric faces away from the outer covering and the front surface of the outer covering faces away from the interior hook fabric;

a tube including inner and outer surfaces and a longitudinal slit forming opposing longitudinal edges, the tube sized in relation to the outer covering and the constricted area of the bundle of hair to be adorned; and end caps secured to the assembled outer covering, interior hook fabric, and tube along each longitudinal edge of the tube;

wherein the assembled outer covering and interior hook fabric is configured for placement around the bundle and over an existing elastic band that surrounds the bundle and forms the constricted area;

wherein the interior hook fabric is configured to mate with the existing elastic band in conjunction with placement of the assembled outer covering and interior hook fabric around the bundle such that the outer covering adorns the bundle of hair and the existing elastic band is obscured from view;

wherein the interior hook fabric is secured to the inner surface of the tube such that the hook surface of the interior hook fabric faces away from the tube;

wherein the tube is configured to receive the constricted area of the bundle of hair through the longitudinal slit in conjunction with placement of the assembled outer covering, interior hook fabric, and tube around the bundle.

4. The apparatus of claim 1, further comprising:

end caps secured to the assembled outer covering, interior hook fabric, and tube along each longitudinal edge of the tube.

5. The apparatus of claim 1 wherein the tube is configured such that the opposing longitudinal edges can be separated to deform the tube to facilitate receiving the constricted area of the bundle of hair and biased to return to a tubular-like form when the opposing longitudinal edges are released.

6. An apparatus for adorning a ponytail, comprising:

an outer covering including a front surface, the outer covering having a select width and a select length and configured to adorn at least a constricted area of a bundle of hair; and an interior hook fabric including a hook surface, the interior hook fabric having width and length dimensions that do not exceed the select width and select length of the outer covering, wherein the interior hook fabric is assembled with the outer covering such that the hook surface of the interior hook fabric faces away from the outer covering and the front surface of the outer covering faces away from the interior hook fabric; and wherein the assembled outer covering and interior hook fabric is configured for placement around the bundle and over an existing elastic band that surrounds the bundle and forms the constricted area;

wherein the interior hook fabric is configured to mate with the existing elastic band in conjunction with placement of the assembled outer covering and interior hook fabric around the bundle such that the outer covering adorns the bundle of hair and the existing elastic band is obscured from view;

wherein a back surface of the outer covering is secured to the interior hook fabric to form a ribbon-like strip with opposing ends, the apparatus further comprising:

a fastening mechanism with mating fastener components secured to the opposing ends of the ribbon-like strip, the fastening mechanism further comprising:

a loop fabric secured to the front surface of the outer covering at a first end of the ribbon-like strip; and a portion of the interior hook fabric at the other end of the ribbon-like strip;

wherein the loop fabric is configured to mate with the hook surface of the interior hook fabric at the other end of the ribbon-like strip to fasten the opposing ends of the ribbon-like fabric together in conjunction with placement of the assembled outer covering, interior hook fabric, and fastening mechanism around the bundle.

7. The apparatus of claim 6, further comprising:

an end cap secured to the assembled outer covering, interior hook fabric, and fastening mechanism along one or more of the opposing ends of the ribbon-like strip.

8. An apparatus for adorning a ponytail, comprising:

an outer covering including a front surface, the outer covering having a select width and a select length and configured to adorn at least a constricted area of a bundle of hair; and an interior hook fabric including a hook surface, the interior hook fabric having width and length dimensions that do not exceed the select width and select length of the outer covering, wherein the interior hook fabric is assembled with the outer covering such that the hook surface of the interior hook fabric faces away from the outer covering and the front surface of the outer covering faces away from the interior hook fabric;

wherein the assembled outer covering and interior hook fabric is configured for placement around the bundle and over an existing elastic band that surrounds the bundle and forms the constricted area;

wherein the interior hook fabric is configured to mate with the existing elastic band in conjunction with placement of the assembled outer covering and interior hook fabric around the bundle such that the outer covering adorns the bundle of hair and the existing elastic band is obscured from view;

wherein the outer covering includes front and back portions forming a sleeve with opposing open ends, the apparatus further comprising:

a tube including inner and outer surfaces and a longitudinal slit forming opposing longitudinal edges, the tube sized in relation to the outer covering and the constricted area of the bundle of hair to be adorned;

wherein the interior hook fabric is secured to the back portion of the outer covering such that the hook surface of the interior hook fabric faces away from the outer covering;

wherein the assembled outer covering and interior hook fabric is configured to slide over the tube by feeding a first longitudinal edge through the sleeve from a first open end until both longitudinal edges are covered by the sleeve;

wherein the covered tube is configured to receive the constricted area of the bundle of hair through the longitudinal slit in conjunction with placement of the assembled outer covering, interior hook fabric, and tube around the bundle.

9. The apparatus of claim 8 wherein one end of the sleeve is closed by securing the front and back portions of the outer covering together at that end to form a pocket defined by the sleeve, the closed end, and the remaining open end;

wherein the remaining open end of the sleeve is closed by securing the front and back portions of the outer covering together at that end after both longitudinal edges of the tube are covered by the sleeve.

10. The apparatus of claim 8, further comprising:

end caps secured to the assembled outer covering, interior hook fabric, and tube along each longitudinal edge of the tube after both longitudinal edges of the tube are covered by the sleeve.

11. The apparatus of claim 8 wherein the tube is configured such that the opposing longitudinal edges can be separated to deform the tube to facilitate receiving the constricted area of the bundle of hair and biased to return to a tubular-like form when the opposing longitudinal edges are released.

12. A kit for making a ponytail holder configured to adorn a ponytail, the kit comprising:

a template configured to mark a covering material to facilitate forming an outer covering from the covering material, the outer covering having a front surface, the template defining a select width and a select length for the outer covering, the outer covering configured to adorn at least a constricted area of a bundle of hair;

an interior hook fabric including a hook surface, the interior hook fabric having width and length dimensions that do not exceed the select width and select length for the outer covering;

a tube including inner and outer surfaces and a longitudinal slit forming opposing longitudinal edges, the tube sized in relation to the outer covering and the constricted area of the bundle of hair to be adorned, wherein the outer covering, interior hook fabric, and tube are configured to be assembled such that the hook surface of the interior hook fabric faces away from the outer covering and the front surface of the outer covering faces away from the interior hook fabric; and end caps configured to be secured to the assembled outer covering, interior hook fabric, and tube along each longitudinal edge of the tube to form a ponytail holder;

wherein the ponytail holder is configured for placement around the bundle and over an existing elastic band that surrounds the bundle and forms the constricted area;

wherein the interior hook fabric is configured to mate with the existing elastic band in conjunction with placement of the ponytail holder around the bundle such that the outer covering adorns the bundle of hair and the existing elastic band is obscured from view.

13. A method of manufacturing an apparatus for adorning a ponytail, comprising:

obtaining an outer covering, an interior hook fabric, a tube, and two end caps, the outer covering including a front surface and having a select width and a select length, the interior hook fabric including a hook surface and having width and length dimensions that do not exceed the select width and select length of the outer covering, the tube including inner and outer surfaces and a longitudinal slit forming opposing longitudinal edges, the tube sized in relation to the outer covering;

positioning the interior hook fabric along the inner surface of the tube such that the hook surface of the interior hook fabric faces away from the tube;

positioning the outer covering along the outer surface of the tube such that the front surface of the outer covering faces away from the tube; and securing the end caps to the assembled outer covering, interior hook fabric, and tube along each longitudinal edge of the tube to form a ponytail holder;

wherein the ponytail holder is configured for placement around at least a constricted area of a bundle of hair and over an existing elastic band that surrounds the bundle and forms the constricted area;

wherein the interior hook fabric is configured to mate with the existing elastic band in conjunction with placement of the ponytail holder around the bundle such that the outer covering adorns the bundle of hair and the existing elastic band is obscured from view.

14. The method of claim 13 wherein the hook surface of the interior hook fabric is configured to mate with an exterior surface of the existing elastic band in a hook-and-loop fastening manner in conjunction with placement of the ponytail holder around the bundle.

15. The method of claim 13 wherein the tube is configured to receive the constricted area of the bundle of hair through the longitudinal slit in conjunction with placement of the ponytail holder around the bundle;

wherein the tube is configured such that the opposing longitudinal edges can be separated to deform the tube to facilitate receiving the constricted area of the bundle of hair and biased to return to a tubular-like form when the opposing longitudinal edges are released.

16. The kit of claim 12 wherein the outer covering includes front and back portions and the template is configured to mark the covering material to facilitate forming the front and back portions from the covering material, wherein the outer covering is formed by assembling the front and back portions to form a sleeve with opposing open ends, the kit further comprising:

a tube including inner and outer surfaces and a longitudinal slit forming opposing longitudinal edges, the tube sized in relation to the outer covering and the constricted area of the bundle of hair to be adorned;

wherein the interior hook fabric is configured to be secured to the back portion of the outer covering such that the hook surface of the interior hook fabric faces away from the outer covering;

wherein the assembled outer covering and interior hook fabric is configured to slide over the tube by feeding a first longitudinal edge through the sleeve from a first open end until both longitudinal edges are covered by the sleeve;

wherein the covered tube is configured to receive the constricted area of the bundle of hair through the longitudinal slit in conjunction with placement of the assembled outer covering, interior hook fabric, and tube around the bundle.

17. The method of claim 13 wherein the outer covering includes front and back portions forming a sleeve with opposing open ends, the method further comprising:

securing the interior hook fabric to the back portion of the outer covering such that the hook surface of the interior hook fabric faces away from the outer covering; and sliding the assembled outer covering and interior hook fabric over the tube by feeding a first longitudinal edge through the sleeve from a first open end until both longitudinal edges are covered by the sleeve;

wherein the covered tube is configured to receive the constricted area of the bundle of hair through the longitudinal slit in conjunction with placement of the assembled outer covering, interior hook fabric, and tube around the bundle.

18. The method of claim 13, further comprising:

securing the interior hook fabric to the inner surface of the tube such that the hook surface of the interior hook fabric faces away from the tube; and securing the outer covering to the outer surface of the tube such that the front surface of the outer covering faces away from the tube.

19. The apparatus of claim 6 wherein the hook surface of the interior hook fabric is configured to mate with an exterior surface of the existing elastic band in a hook-and-loop fastening manner in conjunction with placement of the assembled outer covering and interior hook fabric around the bundle.

20. The apparatus of claim 8 wherein the hook surface of the interior hook fabric is configured to mate with an exterior surface of the existing elastic band in a hook-and-loop fastening manner in conjunction with placement of the assembled outer covering and interior hook fabric around the bundle.

21. The apparatus of claim 3 wherein the outer surface of the tube comprises the outer covering.

22. The apparatus of claim 3 wherein the hook surface of the interior hook fabric is configured to mate with an exterior surface of the existing elastic band in a hook-and-loop fastening manner in conjunction with placement of the assembled outer covering and interior hook fabric around the bundle.

23. The apparatus of claim 3 wherein the tube is configured such that the opposing longitudinal edges can be separated to deform the tube to facilitate receiving the constricted area of the bundle of hair and biased to return to a tubular-like form when the opposing longitudinal edges are released.

* * * * *